United States Patent [19]

Holden et al.

[11] Patent Number: 5,069,635

[45] **Date of Patent: * Dec. 3, 1991**

[54] VACUUM CLEANER HOSE CONSTRUCTION AND METHOD OF MAKING THE SAME

[75] Inventors: Homer N. Holden, Sylva; Philip K. Loyer, Waynesville, both of N.C.; Lowell T. Noyes, Redding, Conn.; Janos J. Legrady, Putnam Valley, N.Y.

[73] Assignee: Dayco Products, Inc., Dayton, Ohio

[ * ] Notice: The portion of the term of this patent subsequent to Jan. 16, 2007 has been disclaimed.

[21] Appl. No.: 427,421

[22] Filed: Oct. 26, 1989

Related U.S. Application Data

[62] Division of Ser. No. 237,344, Aug. 26, 1988, Pat. No. 4,894,020

[51] Int. Cl.[5] ..... H01R 4/24

[52] U.S. Cl. ..... 439/400; 439/443; 29/857

[58] Field of Search ..... 439/395, 396, 191, 192, 439/387, 389, 400, 296, 370, 259, 263, 443; 29/857

[56] References Cited

U.S. PATENT DOCUMENTS

| | | | |
|---|---|---|---|
| 3,634,605 | 1/1972 | Dola | 174/88 R |
| 4,456,321 | 6/1984 | Jones et al. | 439/395 |
| 4,740,171 | 4/1988 | Holden et al. | 439/191 |

FOREIGN PATENT DOCUMENTS

| | | | |
|---|---|---|---|
| 2549302 | 1/1985 | France | 439/395 |

*Primary Examiner*—Neil Abrams
*Assistant Examiner*—Khiem Nguyen
*Attorney, Agent, or Firm*—Joseph V. Tassone

[57] ABSTRACT

A vacuum cleaner hose construction and method of making the same are provided, the vacuum cleaner hose construction comprising an elongated vacuum hose having an electrical conductor extending therealong and being provided with an end portion, and an electrical connector carried by the hose and being fixed to the end portion, the connector having a pair of spaced apart knife-like portions each being provided with opposed edges defining sides of a slot therein that has an open end and a closed end, the knife-like portions of the connector having the open ends of the slots thereof facing in the same direction and being interconnected together at one end thereof to an intermediate part of the connector whereby the portions and the part define a U-shaped configuration that has a bight facing in the same direction as the open end of the slots, the end portion being disposed in the slots of the connector and being wedged between the opposed edges thereof for providing electrical connection therebetween, the connector having a holding unit carried thereby and disposed adjacent the conductor to hold the conductor in the slots by trapping the conductor between the holding unit and the closed ends of the slots, the holding unit comprising a U-shaped holding member having a pair of spaced apart legs and a cross member interconnecting the legs together, the legs being respectively disposed adjacent the knife-like portions and between the same, the bight of the U-shaped holding member facing in the same direction as the bight of the connector.

16 Claims, 2 Drawing Sheets

VACUUM CLEANER HOSE CONSTRUCTION AND METHOD OF MAKING THE SAME

CROSS REFERENCE TO RELATED APPLICATION

This application is a divisional patent application of its copending parent patent application, Ser. No. 237,344, filed Aug. 26, 1988, now U.S. Pat. No. 4,894,020.

BACKGROUND OF THE INVENTION

1. Field of the Invention

This invention relates to a new vacuum cleaner hose construction as well as to a new method of making a vacuum cleaner hose construction.

2. Prior Art Statement

It is known to provide a vacuum cleaner hose construction that comprises an elongated vacuum hose having an electrical conductor extending therealong and being provided with an end portion, and an electrical connector carried by the hose and being fixed to the end portion, the connector having a pair of spaced apart knife-like portions each being provided with opposed edges defining sides of a slot therein that has an open end and a closed end, the knife-like portions of the connector having the open ends of the slots thereof facing in the same direction and being interconnected together at one end thereof to an intermediate part of the connector whereby the portions and the part define a U-shaped configuration that has a bight facing in the same direction as the open ends of the slots, the end portion being disposed in the slots of the connector and being wedged between the opposed edges thereof for providing electrical connection therebetween, the connector having holding means carried thereby and disposed adjacent the conductor to hold the conductor in the slots by trapping the conductor between the holding means and the closed ends of the slots, the holding means comprising a U-shaped holding member having a pair of spaced apart legs and a cross member interconnecting the legs together, the legs being respectively disposed adjacent the knife-like portions and between the same. For example, see the U.S. Pat. No. to Holden et al, No. 4,740,171.

Also, see the U. S. Pat. No. to Dola, No. 3,634,605 and the U. S. Pat. No. to Jones et al, No. 4,456,321 for U-shaped holding means that hold conductors in the slots of knife-like portions on a U-shaped connector member.

SUMMARY OF THE INVENTION

It is one feature of this invention to provide a new vacuum cleaner hose construction wherein unique holding means are provided for holding an end portion of an electrical conductor of a vacuum hose in the slots of a terminal connector that is fixed to that end portion of the conductor.

In particular, it was found according to the teachings of this invention that the holding means can comprise a U-shaped holding member having a pair of spaced apart legs and a cross member interconnecting the legs together and being inserted between the knife-like portions of the connector to be snap-fitted thereto in such a manner that the bight of the U-shaped holding member can face in the same direction as the bight of the connector that is defined by the knife-like portions thereof.

For example, one embodiment of this invention provides a vacuum hose construction that comprises an elongated vacuum hose having an electrical conductor extending therealong and being provided with an end portion, and an electrical connector carried by the hose and being fixed to the end portion, the connector having a pair of spaced apart knife-like portions each being provided with opposed edges defining sides of a slot therein that has an open end and a closed end, the knife-like portions of the connector having the open ends of the slots thereof facing in the same direction and being interconnected together at one end thereof to an intermediate part of the connector whereby the portions and the part define a U-shaped configuration that has a bight facing in the same direction as the open ends of the slots, the end portion being disposed in the slots of the connector and being wedged between the opposed edges thereof for providing electrical connection therebetween, the connector having holding means carried thereby and disposed adjacent the conductor to hold the conductor in the slots by trapping the conductor between the holding means and the closed ends of the slots, the holding means comprising a U-shaped holding member having a pair of spaced apart legs and a cross member interconnecting the legs together, the legs being respectively disposed adjacent the knife-like portions and between the same, the bight of the U-shaped holding member facing in the same direction as the bight of the connector, each leg of the holding member having a pair of spaced apart snap-fitting means snap-fitting with its respective knife-like portion of the connector to hold the holding member to the connector, each pair of the snap-fitting means being disposed on a line that generally passes through the conductor.

Accordingly, it is an object of this invention to provide a new vacuum hose construction having one or more of the novel features of this invention as set forth above or hereinafter shown or described.

Another object of this invention is to provide a new method of making a vacuum hose construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
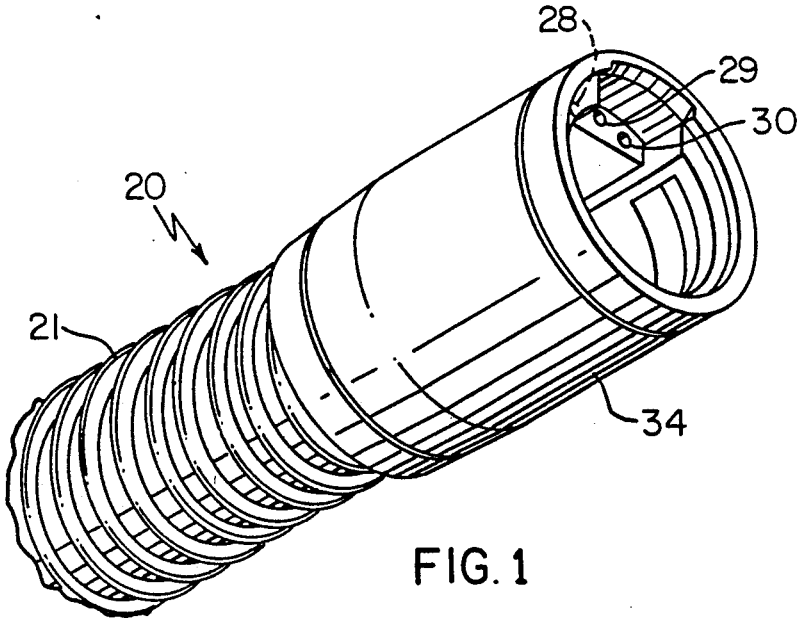
FIG. 1 is a fragmentary perspective view of the new vacuum cleaner hose construction of this invention.

While the various features of this invention are hereinafter illustrated and described as being particularly adapted to provide a new electrical assembly means for a vacuum cleaner hose, it is to be understood that the various features of this invention can be utilized singly or in various combinations thereof to provide a new electrical assembly means for other structure as desired.

Therefore, this invention is not to be limited to only the embodiments illustrated in the drawings, because the drawings are merely utilized to illustrate one of the wide variety of uses of this invention.

Figure 2:
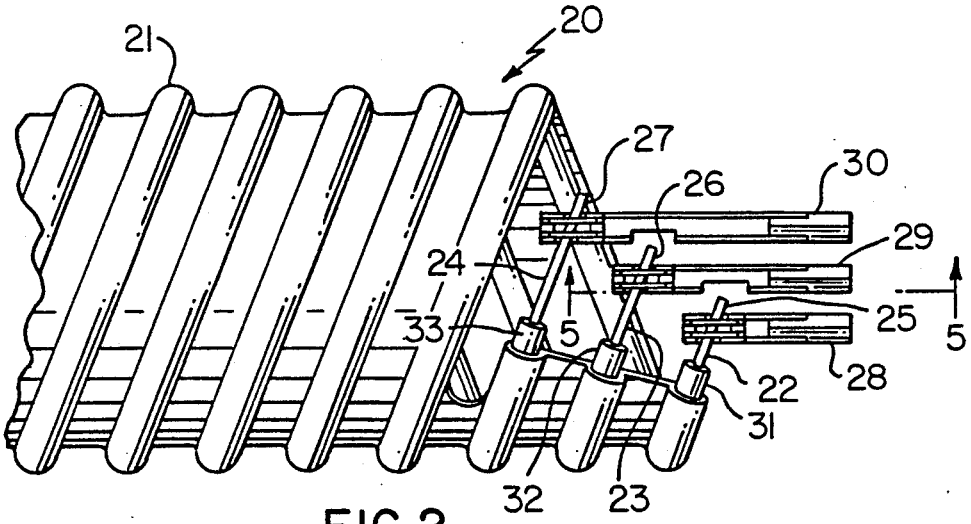
FIG. 2 is an enlarged fragmentary view illustrating the hose of FIG. 1 having a plurality of electrical assembly means of this invention interconnected to the plurality of conductors thereof and before a cuff has been molded thereon that completes the assembly as illustrated in FIG. 1.
Figure 3:
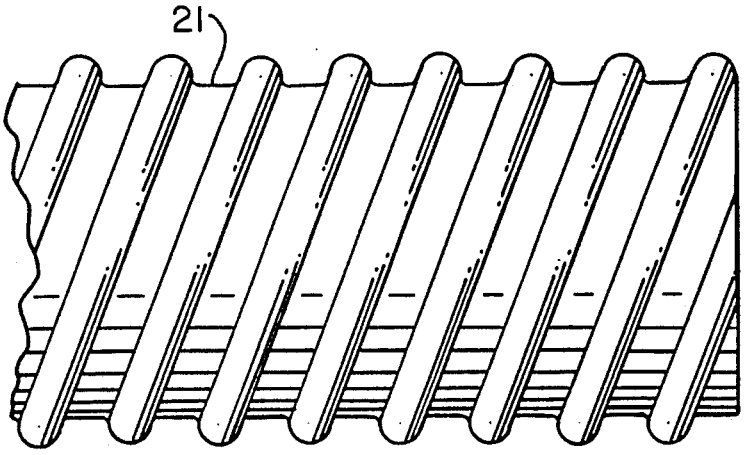
FIG. 3 is a view similar to FIG. 1 and illustrates the hose before the same has been cut to bare the conductors thereof.
Figure 4:
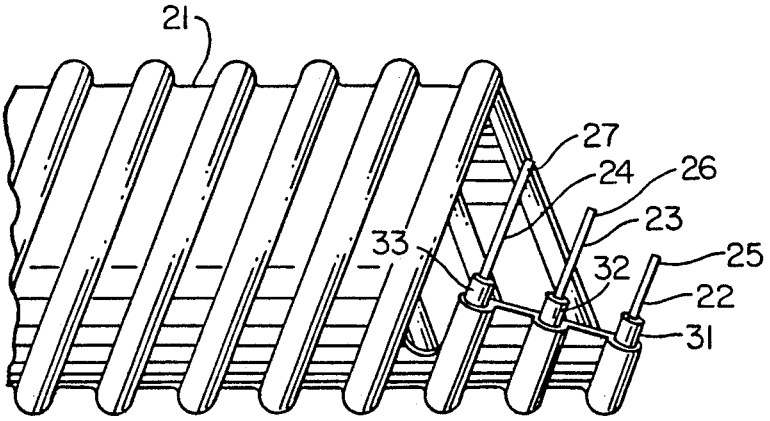
FIG. 4 is a view similar to FIG. 3 and illustrates the hose after the same has been cut in a manner to bare the end portions of the conductor thereof.

Referring now to FIGS. 1 and 2, the new vacuum cleaner hose construction of this invention is generally indicated by the reference numeral 20 and comprises an elongated vacuum hose 21 having one or more electrical conductors, such as metallic conductors 22, 23 and 24, extending therealong and being respectively provided with end portions 25, 26 and 27, and a plurality of electrical terminal connectors 28, 29 and 30 respectively fixed to the end portions 25, 26 and 27 in a manner hereinafter set forth, the vacuum hose 21 being formed of any suitable material, such as polymeric material, and having the conductors 22, 23 and 24 helically disposed therealong and embedded therein in a conventional manner so that not only must the polymeric material of the hose 31 be removed from the end portions 25, 26 and 27 thereof, but also any original insulation means 31, 32 and 33 on the wire conductors 22, 23 and 24 must be removed so as to permit the terminal connectors 28, 29 and 30 to be fastened thereto in a manner hereinafter set forth. However, it is to be understood that the original insulation means need not be removed from the end portions 25, 26 and 27 of the conductors 22, 23 and 24 as the terminal connectors 28, 29 and 30 will sever through such insulation means and make electrical contact with the electrical conductors for a purpose that is conventional in the art and is fully set forth in the U.S. Pat. No. to Holden, No. 3,928,715 as well as the aforementioned U.S. Pat. No. to Holden et al, No. 4,740,171 whereby these two patents are being incorporated into this disclosure by this reference thereto.

Therefore, since it is well known to fasten one or more terminal connectors to a conductor that is originally embedded in a helical manner along a vacuum hose and thereafter dispose an annular end cuff of polymeric material over the resulting terminal assembly in the manner provided by the cuff 34 of the hose construction 20 of FIG. 1, as well as to provide terminal connectors and an end cuff at the other end (not shown) of the hose 21 in order to complete the hose construction 20 for use with a vacuum cleaner in a conventional manner, only the details of the hose construction 20 of this invention that is necessary to understand the features of this invention will now be set forth as the other structure and details of a vacuum cleaner hose construction are conventional in the art as fully set forth in the aforementioned U.S. Pat. No. to Holden, No. 3,928,715 and the U.S. Pat. No. to Holden et al, No. 4,740,171.

Also, because the terminal connectors 28, 29 and 30 are identical except for the length thereof, as is evidenced by FIG. 2, only the terminal connector 29 will now be described with the understanding that such structure applies to the other terminal connectors 28 and 30.

Figure 5:
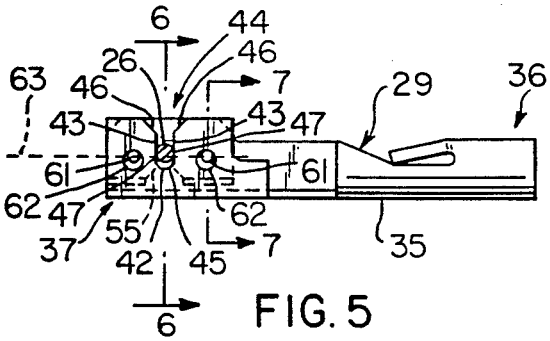
FIG. 5 is an enlarged cross-sectional view taken on line 5—5 of FIG. 2.
Figure 8:
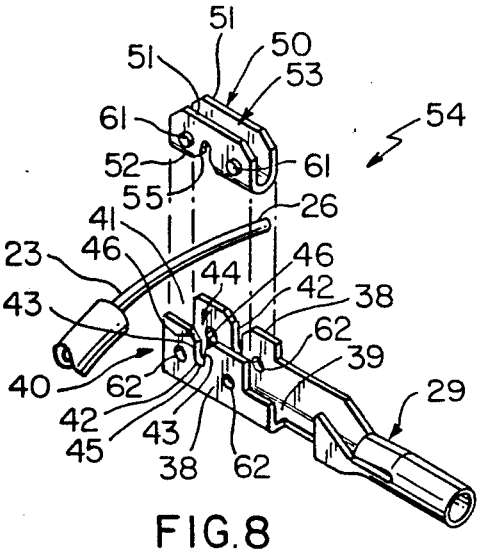
FIG. 8 is an exploded perspective view of the various parts that form the assembly of FIG. 1.
Figure 9:
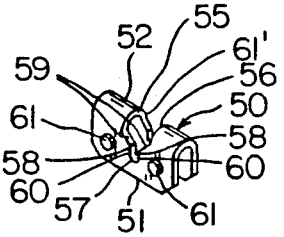
FIG. 9 is a perspective view of the other side of the holding means of the assembly of FIG. 8.

As illustrated in FIGS. 5 and 8, the terminal connector 29 is formed from any suitable metallic material and has a body portion 35 provided with opposed ends 36 and 37, the end 36 being suitably shaped to either comprise a female means or a male means for interconnecting to another electrical conductor in a manner well known in the art.

The end 37 of the body portion 35 of the connector 29 is defined by a pair of knife-like portions 38 being disposed and held in spaced apart substantially parallel relation by a substantially flat bridging portion 39 of the connector 29 whereby the knife-like portions 38 and bridging portion 39 define a generally U-shaped cross-sectional configuration that is generally indicated by the reference numeral 40 and has a bight 41 that faces away from the bridging portion 39 as illustrated.

Figure 6:
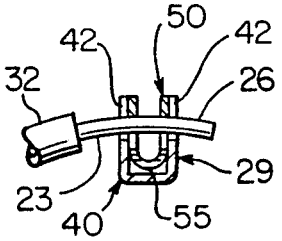
FIG. 6 is a fragmentary cross-sectional view taken on line 6—6 of FIG.

The knife-like portions 38 of the terminal connector 29 each has a slot 42 formed therein and defined by opposed side edges 43. Each slot 42 has an open end 44 and a closed end 45, the open end 44 being defined by the side edges 43 diverging away from each other to provide cam surfaces 46 that lead to generally straight and parallel sections 47 of the side edges 43 while the closed end 45 of the slot 42 is substantially semi-circular as illustrated. The straight parallel sections 47 of the side edges 43 are spaced apart a distance that is slightly less than the diameter of the respective conductor 23 so as to not only cut through any insulating coating thereon, but also to cut slightly into the actual metal of the conductor 23 when the end portion 26 thereof is being disposed down into the slots 42 of the knife-like portions 38 of the terminal connector 29 as illustrated in FIGS. 5 and 6. In this manner, the conductor 23 is wedged between the opposed side edges 43 of the knife-like portions 38 to provide an electrical connection between the conductor 23 and the terminal connector 29.

While the knife-like portions 38 of the terminal connector 29 are shown as being single thickness sections of metal, it is to be understood that the same could be a plurality of sections folded against each other such as set forth in the aforementioned U.S. Pat. No. to Holden, No. 3,928,715 and the slots 42 can have other than the generally U-shape thereof such as by being substantially keyhole-shaped as set forth in the aforementioned U.S. Pat. No. to Holden, No. 3,928,715, if desired.

While the structure of the terminal connector 29 previously described is substantially the same as the structure of certain of the terminal connectors set forth in the aforementioned U.S. Pat. No. to Holden et al, No. 4,740,171, the terminal connector 29 of this invention has a unique holding means that is generally indicated by the reference numeral 50 and which is utilized for holding the end portion 26 of the conductor 23 in the slots 42 of the knife-like portions 38 after the end portion 26 has been disposed therein or at the same time that the end portion 26 is being disposed therein as will be readily apparent hereinafter.

Figure 7:
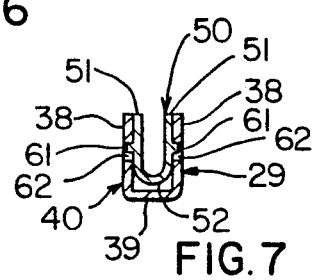
FIG. 7 is a fragmentary cross-sectional view taken on line 7—7 of FIG. 5.

In particular, the unique holding means 50 of this invention comprises a metallic one-piece member having a pair of knife-like portions 51 disposed and held in spaced apart parallel relation by an integral bridging member 52 which is of such a dimension that the knife-like portions 51 are adapted to be disposed between and closely adjacent the knife-like portions 38 in the manner illustrated in FIGS. 6–8, the knife-like portions 51 and bridging member 52 of the holding means 50 defining a generally U-shaped structure that has a bight 53 that is adapted to face in the same direction as the bight 41 of the terminal connector 29 when the holding member 50 is assembled thereto as will be apparent hereinafter.

Thus, it can be seen that the holding means 50 and its terminal connector 29 comprise a unique electrical assembly means of this invention that is generally indicated by the reference numeral 54.

The knife-like portions 51 of the holding means 50 respectively have slot means 55 formed therein which have open ends 56 and closed ends 57 and which are of substantially the same configuration and size as the slot means 42 of the knife-like portions 41 and thereby have opposed side edges 58 with camming portions 59 and substantially straight portions 60. The open ends 56 of the slots 55 are joined together by a slot means 61' formed through the cross member 52 of the holding means 50 and is of the same size as the open ends 56 to thereby permit the end portion 26 of the conductor 23 to pass through the slot 61' of the holding means 50 to enter into the opening means 56 of the slots 55 and thereby be wedged between the straight sections 60 of the side edges 58 thereof to provide electrical continuity between the holding means 50 and the conductor 23 in the same manner as provided by the edges 43 of the slots 42 as previously set forth.

Therefore, it can be seen that the holding means 50 is a substantially U-shaped member that has the knife-like portions 51 thereof defining substantially straight parallel legs and the bridging portion 52 defining a cross member thereof whereby the bight 53 faces away from the cross member 52 as previously set forth.

The holding means 50 of this invention is adapted to be snap-fitted to the terminal connector 29 to hold the holding means 50 in its final position between the knife-like portions 38 thereof, the snap-fit means comprising a pair of outwardly projecting dimples or projections 61 formed on each knife-like portion 51 on opposite sides of the slot means 55 thereof while the knife-like portions 38 of the terminal connector 29 have mating snap-fit means defined as openings 62 formed on opposite sides of the slots 42 thereof. In this manner, when it is desired to interconnect the end portion 26 of the conductor 23 to the terminal connector 29, the end portion 26 can be disposed in the open ends 46 of the slots 42 and then the holding member 50 can be moved downwardly against the same so that the end portion 26 of the conductor 23 is also received in the open ends 56 of the slots 55 of the holding means 50 with such insertion of the holding means 50 into the bight 41 of the conductor 29 causing the end portion 26 of the conductor 23 to be wedged between the straight portions 47 of the side edges 43 of the knife-like portions 38 of the terminal connector 29 as well as between the straight portions 60 of the side edges 58 of the knife-like portions 51 of the holding means 50 by the time that the snap-fit means 61 of the holding means 50 align with the snap-fit means 62 of the terminal connector 29 to snap-fit therein and thereby snap-fit the holding means 50 in place in the manner illustrated in FIG. 7.

While it is preferred that the bottom or bridging portion 52 of the holding means 50 remain spaced from the bridging portion 39 of the terminal connector 29 when the snap-fit means 61 and 62 are interconnected together in the manner illustrated in FIG. 7 and while it is preferred that when the snap-fit means 61 and 62 are snap-fit together, the end portion 26 of the conductor 23 has not bottomed out against the closed ends 45 and 57 of the slot means 42 and 55, it is to be understood that the bottom portion 52 of the holding means 50 could bottom out against the end 39 of the terminal connector 29 and that the conductor 23 could be bottomed out against the closed ends 45 and 57 of the slots 42 and 55 if desired.

In any event, it can be seen that when the holding means 50 has been snap-fitted in place, the snap-fit means 61 of each leg 51 are disposed on a line that generally passes through the conductor 26. For example, see line 63 in FIG. 5.

Also, while the snap-fit projections 61 of the holding means 50 are shown smaller in diameter than the diameter of the openings 62 in the knife-like portions 38, it is to be understood that the diameters could be in any suitable sized relation to perform the desired function thereof as previously set forth.

Therefore, it can be seen that the holding means 50 traps the end portion 26 of the conductor 23 in its electrical interconnecting condition with the terminal connector 29 for the reasons fully set forth in the aforementioned U.S. Pat. No. to Holden et al, No. 4,740,171.

Therefore, it can be seen that this invention not only provides a new vacuum cleaner hose construction, but also this invention provides a new method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a construction that comprises an electrical conductor provided with an end portion, and an electrical connector fixed to said end portion, said connector having a pair of spaced apart knife-like portions each being provided with opposed edges defining sides of a slot therein that has an open end and a closed end, said knife-like portions of said connector having said open ends of said slots thereof facing in the same direction and being interconnected together at one end thereof to an intermediate part of said connector whereby said portions and said part define a U-shaped configuration that has a bight facing in the same direction as said open ends of said slots, said end portion being disposed in said slots of said connector and being wedges between said opposed edges thereof for providing electrical connection therebetween, said connector having holding means carried thereby and disposed adjacent said conductor to hold said conductor in said slots by trapping said conductor between said holding means and said closed ends of said slots, said holding means comprising a U-shaped holding member having a pair of spaced apart legs and a cross member interconnecting said legs together, said legs being respectively disposed adjacent said knife-like portions and between the same, the improvement wherein the bight of said U-shaped holding member faces in the same direction as said bight of said connector and wherein said leg of said holding member has a pair of spaced apart snap-fitting means snap-fitting with its respective knife-like portion of said connector to hold said holding member to said connector, each pair of said snap-fitting means being disposed on a line that generally passes through said conductor, said legs of said holding means comprising a pair of knife-like portions disposed in spaced apart parallel relation and being interconnected together by said cross member, each knife-like portion of said holding means having opposed edges defining sides of a slot therein that has an open end and a closed end, said knife-like portions of said holding means having said open ends of said slots thereof facing in a like direction that is opposite to the direction that said slots of said connector face.

2. A construction as set forth in claim 1 wherein said holding means initially was separate from said connector.

3. A construction as set forth in claim 1 wherein said cross member of said holding means has a slot therein that interconnects with said slots of said knife-like portions of said holding means at said open ends thereof.

4. A construction as set forth in claim 3 wherein said cross member of said holding means is disposed spaced from said intermediate part of said connector.

5. A construction as set forth in claim 4 wherein said knife-like portions of said connector each has a pair of spaced apart snap-fit means respectively snap-fitting with said snap-fit means of its respective leg of said holding means with said cross member of said holding means being spaced from said intermediate part of said conductor.

6. A construction as set forth in claim 5 wherein said pair of snap-fit means of each of said knife-like portions are disposed respectively on opposite sides of said slot thereof.

7. A construction as set forth in claim 6 wherein each said snap-fit means of said connector comprises an opening means and wherein each said snap-fit means of said holding means comprises a projection means.

8. A construction as set forth in claim 7 wherein said projection means are each substantially cylindrical and wherein said openings are each substantially circular with a diameter larger than the diameter of said projection means.

9. In a method of making a construction that comprises an electrical conductor provided with an end portion, and an electrical connector fixed to said end portion, said connector having a pair of spaced apart knife-like portions each being provided with opposed edges defining sides of a slot therein that has an open end and a closed end, said knife-like portions of said connector having said open ends of said slots thereof facing in the same direction and being interconnected together at one end thereof to an intermediate part of said connector whereby said portion and said part define a U-shaped configuration that has a bight facing in the same direction as said open ends of said slots, said end portion being disposed in said slots of said connector and being wedged between said opposed edges thereof for providing electrical connection therebetween, said connector having holding means carried thereby and disposed adjacent said conductor to hold said conductor in said slots by trapping said conductor between said holding means and said closed ends of said slots, said holding means comprising a U-shaped holding member having a pair of spaced apart legs and a cross member interconnecting said legs together, said legs being respectively disposed adjacent said knife-like portions and between the same, the improvement comprising the steps of disposing said holding member between said knife-like portions so that the bight of said U-shaped holding member faces in the same direction as said bight of said connector, forming each leg of said holding member to have a pair of spaced apart snap-fitting means that snap-fit with its respective knife-like portion of said connector to hold said holding member to said connector, forming each pair of said snap-fitting means to be disposed on a line that generally passes through said conductor, forming said legs of said holding means to comprise a pair of knife-like portions disposed in spaced apart parallel relation and being interconnected together by said cross member, forming each knife-like portion of said holding means to have opposed edges defining sides of a slot therein that has an open end and a closed end, and forming said knife-like portions of said holding means to have said open ends of said slots thereof facing in a like direction that is opposite to the direction that said slots of said connector face.

10. A method of making a construction as set forth in claim 9 and including the step of forming said holding means to initially be separate from said connector.

11. A method of making a construction as set forth in claim 9 and including the step of forming said cross member of said holding means to have a slot therein that interconnects with said slots of said knife-like portions of said holding means at said open ends thereof.

12. A method of making a construction as set forth in claim 11 and including the step of forming said cross member of said holding means to be disposed spaced from said intermediate part of said connector.

13. A method of making a construction as set forth in claim 12 and including the step of forming said knife-like portions of said connector to each have a pair of spaced apart snap-fit means respectively snap-fitting with said snap-fit means of its respective leg of said holding means with said cross member of said holding means being spaced from said intermediate part of said connector.

14. A method of making a construction as set forth in claim 13 and including the step of forming said pair of snap-fit means of each of said knife-like portions to be disposed respectively on opposite sides of said slot thereof.

15. A method of making a construction as set forth in claim 14 and including the step of forming each said snap-fit means of said connector to comprise an opening means and wherein each said snap-fit means of said holding means comprises a projection means.

16. A method of making a construction as set forth in claim 15 and including the steps of forming said projection means to each be substantially cylindrical, and forming said openings to each be substantially circular with a diameter larger than the diameter of said projection means.

* * * * *